US011939124B2

(12) United States Patent
Krautkramer

(10) Patent No.: US 11,939,124 B2
(45) Date of Patent: Mar. 26, 2024

(54) SCREW CLOSURE WITH CONTROLLED SEAL

(71) Applicant: Bericap GmbH & Co. KG, Budenheim (DE)

(72) Inventor: Gunter Krautkramer, Budenheim (DE)

(73) Assignee: BERICAP GMBH & CO. KG, Budenheim (DE)

( * ) Notice: Subject to any disclaimer, the term of this patent is extended or adjusted under 35 U.S.C. 154(b) by 381 days.

(21) Appl. No.: 17/058,635

(22) PCT Filed: Jul. 2, 2019

(86) PCT No.: PCT/EP2019/067690
§ 371 (c)(1),
(2) Date: Nov. 24, 2020

(87) PCT Pub. No.: WO2020/007832
PCT Pub. Date: Jan. 9, 2020

(65) Prior Publication Data

US 2021/0206545 A1 Jul. 8, 2021

(30) Foreign Application Priority Data

Jul. 5, 2018 (DE) ..... 10 2018 116 295.2

(51) Int. Cl.
*B65D 51/16* (2006.01)
*B65D 39/08* (2006.01)

(52) U.S. Cl.
CPC ..... *B65D 51/1661* (2013.01); *B65D 39/08* (2013.01); *B65D 2251/20* (2013.01)

(58) Field of Classification Search
CPC ..... B65D 51/1661
See application file for complete search history.

(56) References Cited

U.S. PATENT DOCUMENTS 4,282,801 A 8/1981 Basch et al.
2004/0035818 A1 2/2004 King
(Continued)

FOREIGN PATENT DOCUMENTS

CN 1486264 A 3/2004
CN 1799946 A 7/2006
(Continued)

OTHER PUBLICATIONS

China National Intellectual Property Administration, Office Action, dated Jan. 18, 2022, Chinese Application No. CN 20198004218.X (English Translation of Office Action).
(Continued)

*Primary Examiner* — Shawn M Braden
(74) *Attorney, Agent, or Firm* — Paul & Paul

(57) ABSTRACT

The invention concerns a plastic closure for fitting on to the neck of a liquid container in positively locking and sealed relationship comprising a head plate (1) provided for covering a container opening and an outer seal (7) which is circumferential along the edge of the head plate (1) and is provided for engagement with the outside of a container neck (20) defining the container opening, and an inner seal (5) which is circumferential within the outer seal (7) and parallel thereto and which is provided for engagement with the inside of the container neck, wherein the outer and the inner seals (7, 5) respectively extend approximately perpendicularly or slightly inclined from an inside (11) of the head plate (1). To provide a closure and also a container having a closure which generally prevent the closure being blown off under a high positive pressure it is proposed according to the invention that the outer seal (7) has a weakened region (6, 6', 6") in at least one circumferential portion so that the outer seal (7) becomes unsealed at a lower internal positive
(Continued)

Figure 1A:
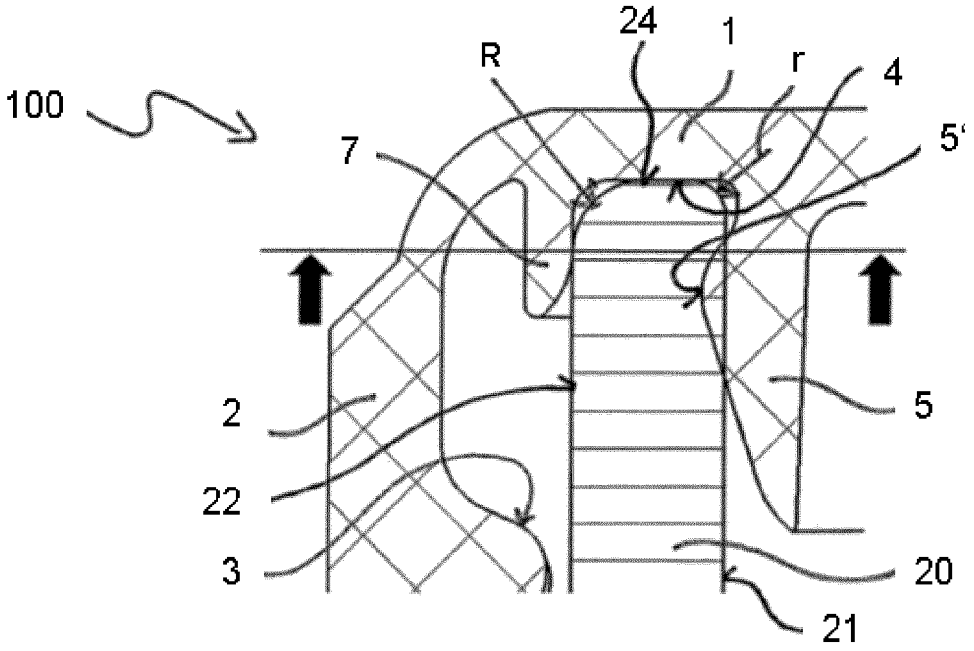

pressure than when the outer seal is of a configuration without the weakened region.

19 Claims, 7 Drawing Sheets

(56) References Cited

U.S. PATENT DOCUMENTS

| | | | | |
|---|---|---|---|---|
| 2006/0138073 | A1 | 6/2006 | Ooka et al. | |
| 2008/0093328 | A1 | 4/2008 | Gaillot et al. | |
| 2013/0256306 | A1 | 10/2013 | Dryer et al. | |
| 2015/0001173 | A1* | 1/2015 | Graux | B65D 41/485 215/320 |

FOREIGN PATENT DOCUMENTS

| | | | | |
|---|---|---|---|---|
| CN | 101087720 | A | 12/2007 | |
| CN | 103261044 | A | 8/2013 | |
| CN | 105857816 | A | 8/2016 | |
| DE | 1748189 | U | 7/1957 | |
| DE | 3151764 | A1 | 9/1982 | |
| DE | 102004011123 | A1 | 3/2005 | |
| EP | 0036886 | B1 | 5/1984 | |
| GB | 2532256 | A * | 5/2016 | B65D 41/0471 |
| WO | 03084833 | A1 | 10/2003 | |

OTHER PUBLICATIONS

Nora Lindner, The International Bureau of the World Intellectual Property Organization, International Preliminary Report on Patentability, PCT/EP2019/067690, dated Jan. 5, 2021 (English translation).

* cited by examiner

SCREW CLOSURE WITH CONTROLLED SEAL

CROSS-REFERENCE TO RELATED APPLICATIONS

This application is a national stage of PCT/EP2019/067690, filed Jul. 2, 2019, and claims the priority of German Application No. 10 2018 116 295.2, filed on Jul. 5, 2018.

The present invention concerns a plastic closure for fitting on to the neck of a liquid container in positively locking and sealed relationship comprising a head plate provided for covering a container opening and an outer seal which is circumferential approximately parallel to the edge of the head plate and is provided for engagement with the outside of a container neck defining the container opening, and an inner seal which is circumferential within the outer seal and parallel thereto and which is provided for engagement with the inside of the container neck, wherein the outer and the inner seals respectively project from an inside of the head plate in the direction of the container neck.

Substantially the circumferential seals extend parallel to each other and approximately perpendicularly or slightly inclined relative to a plane defined by the head plate.

In particular the invention concerns a screw closure of plastic for liquid containers, wherein the screw closure has a head plate, a cylindrical cap skirt with a female thread, which define an axis of the closure, and an annular inner seal which after being fitted on to the container neck is to be brought into engagement with the cylindrical internal surface of the container neck and an annular outer seal which is to be brought into engagement with the cylindrical outside of a container neck, wherein the outer and inner seals respectively extend in a predominantly axial direction from the inside of the head plate.

Such plastic closures are used inter alia for drinks bottles. In that respect the present invention concerns in particular closures for such containers in which an uncontrolled positive pressure can occur. That applies in particular to containers which are filled with a liquid which in principle is fermentable and within which accordingly a considerable positive pressure can build up (after contamination with germs).

When such containers are filled with the products in question they generally do not have a high internal pressure, with the exception of a slight positive pressure which is deliberately applied by filling with an inert gas and which substantially serves to make the bottles which usually comprise thin-walled PET material overall stable and thus stackable, in which case typically a plurality of containers are combined together to constitute a pack and are stacked one upon the other in that form.

In that respect some segments of the market have increasingly found there is a wish on the part of consumers to obtain the container content in a form which is as pure and natural as possible and not to extend the shelf life of the content in question like for example fruit juice or smoothies with preservatives. It will be appreciated that after opening such drinks have a comparatively short best before date, even if they are filled under asceptic conditions. It can therefore happen that, after a consumer has purchased such a container, in particular after it has been first opened, the consumer leaves it for a prolonged time and possibly also at an unfavourable (warm) location, whereby fermentation processes can begin because of an initially low level of germ contamination in the liquid in the container. Upon fermentation gases are typically produced and they in turn increase the pressure in the interior of the container in an uncontrollable fashion. Even if the containers and the corresponding closures are designed for a slight positive pressure (for example 2 bars), in order to make it easier to stack corresponding packs as mentioned above, a pressure occurring due to fermentation can be a multiple higher than the pressure required solely for ensuring stackability, under which the containers were originally filled with an inert gas.

As is usual in the state of the art, the closure according to the invention has two mutually independent seals of which one comes into sealing contact with the inside and the other with the outside of a corresponding container neck (deleted text moved to page 3).

As the containers with the exception of the slight positive pressure already described above for making them stackable are substantially pressureless the closures used for that purpose are generally axially relatively short and also have a relatively steep, usually multi-flight thread, which allows quick opening and closing of the container, while on the other hand affording the closure only a comparatively slight holding action and also only limitedly permitting venting or breathing of the container during the short opening process.

The result of this is that, in the attempt to open a container which is under a relatively high internal pressure, the closure is already explosively blown off the container neck after just a short rotary angle and in that case can seriously injure a user, in particular if delicate body parts like for example an eye are hit by the closure when it is blown off.

It will be appreciated that the invention is not restricted to that specific situation of use but concerns closures for all containers in which a positive pressure of for example more than 4 bars prevails, in particular if such an increased pressure can uncontrolledly occur.

In that respect by virtue of its geometrical arrangement and configuration the inner seal only withstands a limited positive pressure. To limit the internal pressure by the inner seal therefore either no or only slight additional measures are therefore required, as is explained hereinafter. In the known closures however the outer seal can withstand a very considerable positive pressure.

With that background in mind the object of the present invention is to provide a closure and also a container having a closure, which generally prevent the closure being blown off under a high positive pressure.

That object is attained in that the outer seal has a weakened region in at least one circumferential portion, wherein the closure is of such a configuration that the outer seal in the weakened region yields at a lower internal pressure than without the weakened region, in particular yields in the weakened region earlier than in the other regions.

In a screw closure the weakened region preferably extends over an angle sector which is measured with respect to the axis and which depending on the respective nature of the weakened can be limited to less than 1° circumferential angle, but in other embodiments can also be limited to an angle sector of 20 to 90°.

Under some circumstances the weakened region could also extend over the entire circumference, for example in the form of a groove extending in a spiral configuration.

In general terms therefore the object is attained in that the closure from the outset does not allow a correspondingly high positive pressure, that is to say becomes lacking in sealing integrity and allows gas to escape when the pressure in the interior of the container exceeds a given predeterminable amount, more specifically without a pressure relief valve which is to be additionally fitted.

The lower portion (facing away from the head plate) of the inner seal is typically bevelled radially inwardly and is curved inwardly at the end in order to ensure when the closure is being fitted on to the container neck that the inner seal slides into the opening of the container neck. Therefore, the lower end of the inner seal, when the outwardly disposed bead bears against the inside of the container neck, is at a marked internal spacing relative to that inside. In addition on its outside the inner seal has a radially outwardly projecting region or bead which, after corresponding compression by the container neck, bears sealingly under an elastic prestressing against the inside of the container neck.

A positive pressure which occurs in a container provided with the closure generally has the result that the head plate of the closure bulges up. In that case the inner seal is moved a distance upwardly for free opening of the neck and at the same time the inner seal tilts radially inwardly and the pressure of the gas or the liquid which can act from the exterior on the lower portion of the inner seal additionally contributes to radially inward pivotal movement of the inner seal so that as from a certain positive pressure it at least locally lifts away from the inside of the container neck. The inner seal thus becomes non-sealing.

The internal pressure then acts on the outer seal. In that case however the bulging movement of the head plate also causes a reduction in the diameter of the outer seal at least at its attachment to the head plate, which leads to the outer seal being pressed even more firmly against the container neck. Without measures to reduce the internal pressure the above-mentioned risk of the closure abruptly blowing off upon opening of the closure occurs.

By virtue of the weakened region of the outer seal, which is deliberately provided according to the invention however the outer seal also yields at a lower pressure than would be the case if the outer seal did not have any weakened region. In that way the otherwise higher internal pressure is reduced and the risk of a closure being blown off the container neck is completely or at least substantially eliminated. The weakened region is accordingly a means for specifically limiting increased pressure.

By virtue of a suitable geometrical configuration of the weakened region, which can also be readily determined by experiment, it is possible to properly adjust the desired increased pressure value at which the weakened region of the outer seal yields and allows (partial) escape of the gas under pressure in the container. In general the weakened pressure will be set such that the pressure at which the outer seal opens in the weakened region is somewhat above the pressure at which the container is filled in any case for stability reasons, that is to say a pressure of between 1 and 2.5 bars, in which respect precisely observing given pressure values is not an important consideration so long as only the opening pressure of the weakened region is markedly below the values which could cause the closure to be dangerously blown off the container neck. An appropriate upper limit for the internal pressure of containers provided for example for non-carbonated drinks is about 3 to 4 bars for a closure having a two-flight thread with an approximately 360° contact angle and a nominal diameter of 38 mm. Such an appropriate upper limit for the pressure varies with the diameter of the neck and the configuration of the thread and can tend to be greater in the case of a smaller diameter and also smaller in the case of a larger diameter.

The outer seal of the screw closure according to the invention desirably has a region which is referred to hereinafter as the sealing region and which is generally viewed as the axial region which is in sealing contact with a container neck. Specifically, without reference to a (generally standardised) container neck, that is a region of then outer seal of constant inside diameter which at least in part embraces the central third of the axial length of the outer seal. Because of a rounding at the outer edge of a container mouth opening, as is provided as standard in most containers under consideration, in order to ensure that, when the closure is fitted on to the container neck, the outer seal slides on to the outside of the container neck, the region of the outer seal, that is near to the head plate, is not or is scarcely in contact with the container neck.

The end, remote from the head plate, of the outer seal which is generally in the form of a ring or an annular web is generally slightly radially outwardly curved or bevelled (as viewed in an axial section), also in order to make it easier when fitting the closure on to the container neck for it to slide on to the container neck, in which case the outer seal overall is radially enlarged and stretched so that it bears under an elastic prestressing against the container neck and in that way withstands a relatively high internal pressure. In that respect it is to be assumed that the sealing region of an outer seal includes at least a part of the central axial third of the outer seal and the sealing region can then be suitably defined with reference solely to the closure.

Therefore even the radially outwardly curved lower end portion of the outer seal does not bear against the container neck and cannot make any noteworthy contribution to the sealing effect. The actually sealing region of the outer seal is disposed approximately in the central third with respect to the axial length of the outer seal. That is the above-defined sealing region which, in accordance with the present invention, by virtue of specifically targeted measures, is to be influenced or set to a given opening pressure.

In a variant of the invention it is provided that the weakened region comprises a circumferential portion of the outer seal, that is of a reduced wall thickness in relation to the rest of the outer seal, wherein in that weakened region the outer seal is of the same internal radius as the outer seal elsewhere, but is of a smaller external radius.

By virtue of the inside diameter which is constant throughout such an outer seal bears against the outside surface of a container neck with the sealing region thereof along its entire circumference and provides a good sealing action within the required pressure range for which the container and the closure is designed under normal conditions. As however the wall thickness in the weakened region is less than the outer seal in its remaining region that portion of reduced wall thickness in the event of an increased pressure in the interior of the container can more easily stretch and push radially outwardly so that the outer seal lacks a sealing action in that region when the pressure exceeds a predetermined limit value.

Accordingly such a design configuration affords a closure which provides for a complete seal under normal circumstances and which is completely sealed off by an inner seal and also by an outer seal, wherein it is only in the case of a greater internal pressure (for example >4 bars) that the head plate bulges greatly upwardly whereby the inner seal tilts radially inwardly and lifts axially and/or radially off the internal surface of the container neck, whereupon the higher pressure which acts on the outer seal is then released by way of the respective weakened region.

In an embodiment of the invention the reduced wall thickness extends in the axial direction from a free axial (lower) end into the upper third of the outer seal, with respect to the axial length of the outer seal outside the weakened region.

For the lifting-off movement of the inner seal inter alia the maximum outside diameter of the inner seal, that is to say the so-called "bead" of the outer seal, is provided at an axial spacing of between only 0.4 and 1.2 mm, preferably less than 1 mm, from the abutment surface, so that that region is very greatly influenced by any movements of the head plate, in particular a bulging movement thereof, and thus at least after a certain increased pressure is reached, and at least at places lifts off the inside surface of the container neck. Gas (or also liquid) which is under an increased pressure can then escape into the region in front of the outer seal, wherein the weakened region of the outer seal limits the pressure which occurs, insofar as, when a limit pressure is exceeded, it allows the pressurised gas to pass. In the event of a sufficient bulge movement of the head plate the sealing bead of the inner seal which defines the maximum diameter thereof can be lifted into the region of the rounded configuration of the inner edge of the bottle neck or beyond so that at any event the inner seal allows gas to pass towards the outer seal or into the region between the outer and inner seals.

Another embodiment provides that the weakened region comprises a circumferential portion of the outer seal, that is axially shortened in the angle sector $\alpha$. By virtue of the fact that the outer seal is shortened in a circumferential portion and the shortening also includes the sealing region an only still axially very short portion of the sealing region bears against the outside of the container neck in the angle sector, and the result of that is that the outer seal in that region which is weakened in that way, solely by virtue of the fact that it is also lifted a distance axially by the bulging head plate, yields at a relatively low increased pressure in the container interior and locally lifts off the container neck so that any increased pressure is relieved in that way. At the same time such an axially shortened sealing region is always still sufficient to ensure sealing of the screw closure in the pressureless state, that is to say when the pressure on both sides of the outer seal is approximately equal or is limited to the regular positive pressure (<2 bars) of the container. In particular an embodiment provides that the axial length of the outer seal in the weakened region is less than two thirds of the axial length of the outer seal outside the weakened region.

That measure also provides that the outer seal and therewith the closure generally becomes non-sealing at a markedly lower internal pressure or reduces an increased internal pressure at an earlier time than a closure having an outer seal without the weakened region. Without a weakening as is provided according to the present invention the outer seal remains sealed until a PET bottle bursts.

The two above-mentioned embodiments can also be readily combined together as shown in the embodiment of FIG. 1. With a combination of a weakened portion of reduced wall thickness and axial shortening of the outer seal in the same circumferential sector or portion the axial shortening can be about a third in relation to the outer seal in the remaining region and the wall thickness should be less than half the wall thickness of the outer seal outside the weakened region, in which case the reduced wall thickness extends axially into the upper third of the outer seal, with respect to the axial length thereof outside the weakened region.

In a further variant it is provided that extending on the internal surface of the outer seal is a groove or a rib which at any event extends over the axial width of the sealing region of the outer seal. A corresponding groove would provide a small passage which bridges over the sealing region and by way of which gas under pressure in the interior of the container, which has possibly already passed the inner seal, can be discharged outwardly without the pressure in the interior of the container being further increased.

A web or a rib which extends radially inwardly on the surface of the outer seal and which otherwise also extends over the axial width of the sealing region acts in a similar fashion as on both sides of such a rib the sealing surface of the outer seal is lifted off the bottle neck and in that way also forms a passage for a gas under pressure.

These embodiments accordingly have an outer seal which permanently has a deliberately set slight leakage. By virtue of a capillary-like passage of for example 0.03 $mm^2$ cross-section that leakage can already sufficiently allow gas to pass, as is liberated for example in a fermentation process. In regard to the dimension of the cross-section of a specifically provided capillary-like passage it is also possible to take account of the fact that, in relation to a closure which is acted upon with liquid from the interior (for example a bottle which is tipped over or is upside down), that passage under some circumstances also has to allow liquid to pass through. Such a capillary opening on the other hand does not represent any problem under normal sales and storage conditions because under such conditions the inner seal still effectively seals off the container interior in relation to the surroundings.

It will be noted that if possible it should also be prevented that impurities and in particular fermentation-causing germs can pass through the outer seal to the mouth of the container neck and possibly into the container neck, by virtue of such a groove or by a projecting region of a sealing surface, as are implemented by a rib. For that reason a corresponding groove and similarly also a corresponding rib should be of a cross-section which is as small as possible and which fulfils the foregoing conditions and which for example is less than 0.05 $mm^2$, in particular less than 0.02 $mm^2$, wherein a corresponding groove and similarly a corresponding rib for example could of a width and also a depth of 0.1 mm each so that the overall cross-section does not exceed 0.01 $mm^2$. The passage cross-section at least for gas can also be markedly less than the above-mentioned values and for example can be only 0.0001 $mm^2$ which is sufficient to reduce a gas pressure which builds up slowly, but which on the other hand opposes a great resistance to the entry of contamination and germs, as long as a reversed pressure difference does not occur.

Therefore such a small passage provides that a pressure prevailing in the interior of the container, which also lifts the inner seal off its engagement with the internal surface of the container neck, is only very slowly and substantially continuously relieved.

Insofar as no positive pressure or no increased pressure occurs in the interior of the container at any event the inner seal prevents the ingress of germs and the like into the container and the risk that possibly solely the container neck mouth becomes contaminated is very slight in the above-described embodiments having a groove or a rib at the internal surface of the outer seal, in consideration of the small cross-section of the groove or rib.

The fact that the inner seal is of an axial length of at least 2 mm with an end portion which conically tapers from its maximum diameter to its axially free end also contributes to the inner seal more easily lifting off the internal surface of the container neck. The pressurised gas in a container does not have any axial counterpart in the conical region outside the internal cross-section of the inner seal and can thus contribute to the inner seal being pressed radially inwardly and thereby losing sealing integrity.

Overall for yielding of the inner seal in the event of an excessively high internal pressure it has also proven to be desirable if the maximum outside diameter of the inner seal is greater by at least 1.5 mm than its maximum inside diameter.

In general the maximum outside diameter of the inner seal is also smaller than the minimum inside diameter of the outer seal because a container mouth opening still has to be accommodated between them, in which case the corresponding inclined run-on surfaces and rounded configurations at the seals and/or at the container neck mouth make it possible for the maximum outside diameter of the inner seal and the minimum diameter of the outer seal to differ only slightly and in particular by markedly less than corresponds to the wall thickness of the container neck.

Between the outer and inner seals the head plate has an annular portion defining an axial abutment surface for the end face of a container neck mouth. The wall thickness in the region of that annular abutment surface can be the same as in the central region of the head plate, but it can in particular also be larger or smaller, in which respect the latter is preferred to make the head plate more easily moveable so that it bulges more in the event of an increased pressure in the interior of the container.

The invention in that respect also concerns a container having a plastic closure, wherein the container has a container neck designed for positively locking and sealing engagement with a plastic closure according to one of claims 1 to 14. In particular the invention also concerns a container having a container neck with a male thread and a screw closure, wherein the maximum outside radius of the inner seal is greater by 0.2 to 0.4 mm than the nominal inside diameter of the bottle neck. Conversely however the inside diameter of the outer seal, that is constant in the sealing region, is smaller by 0.2 to 0.4 mm than the nominal outside diameter of the container neck. This provides that both seals bear under a prestressing against the inside and the outside respectively of the container neck while the end face thereof butts axially against the annular abutment surface of the head plate, that is between the outer seal and the inner seal.

Figure 1B:
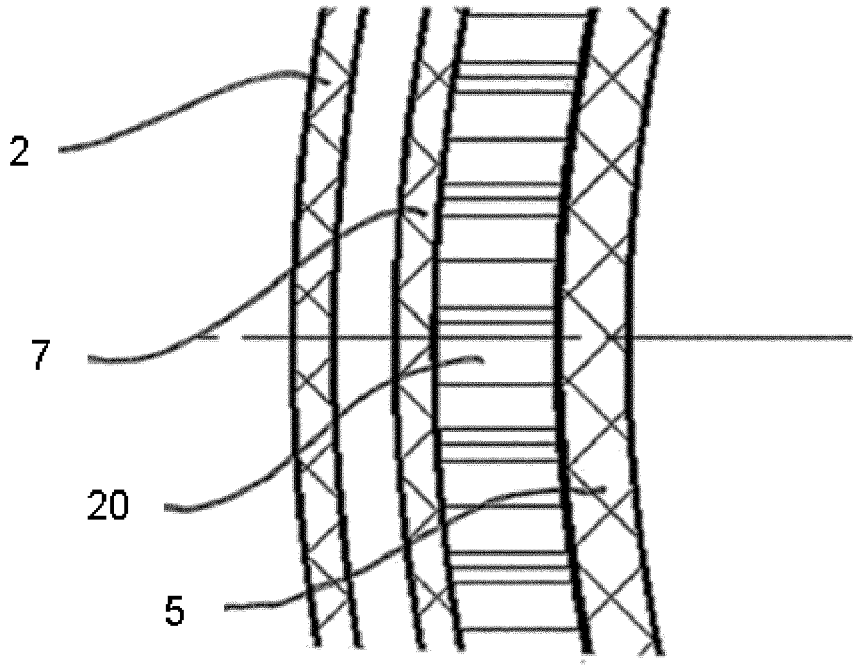
Figure 2:
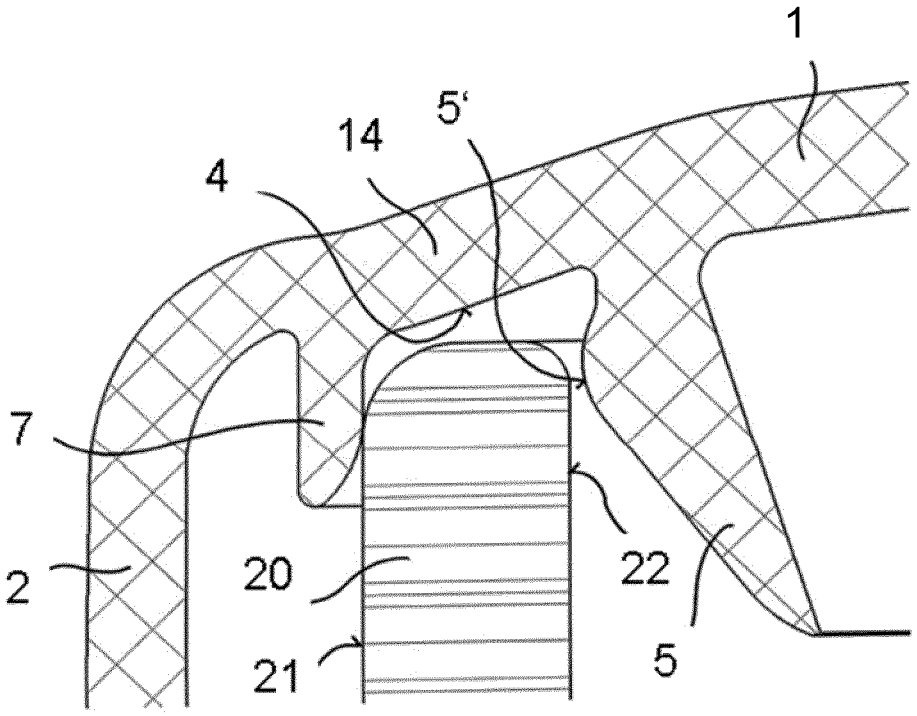
Figure 8:
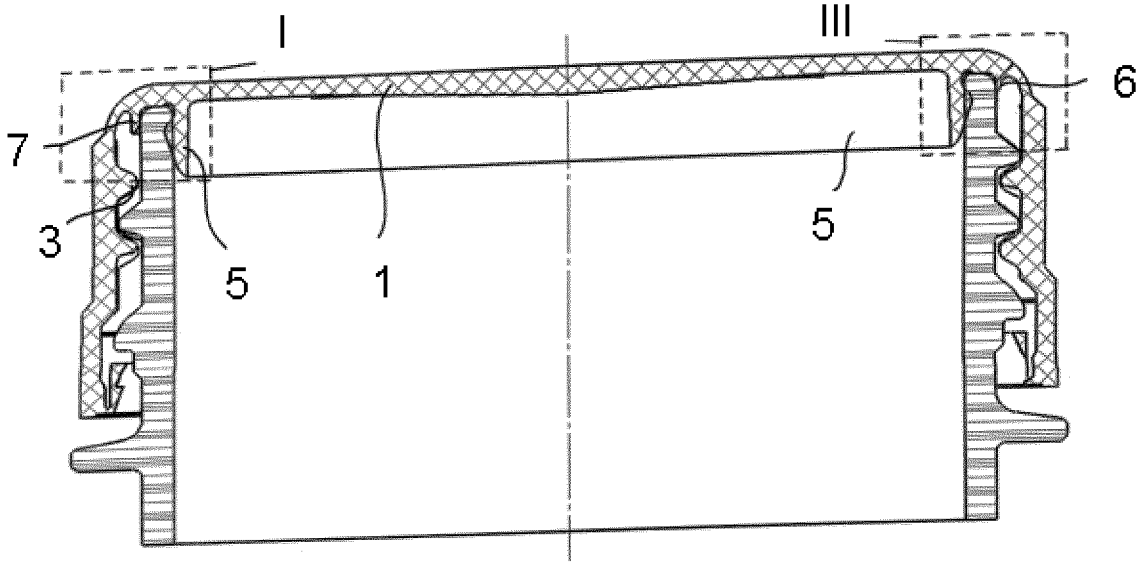
Figure 3A:
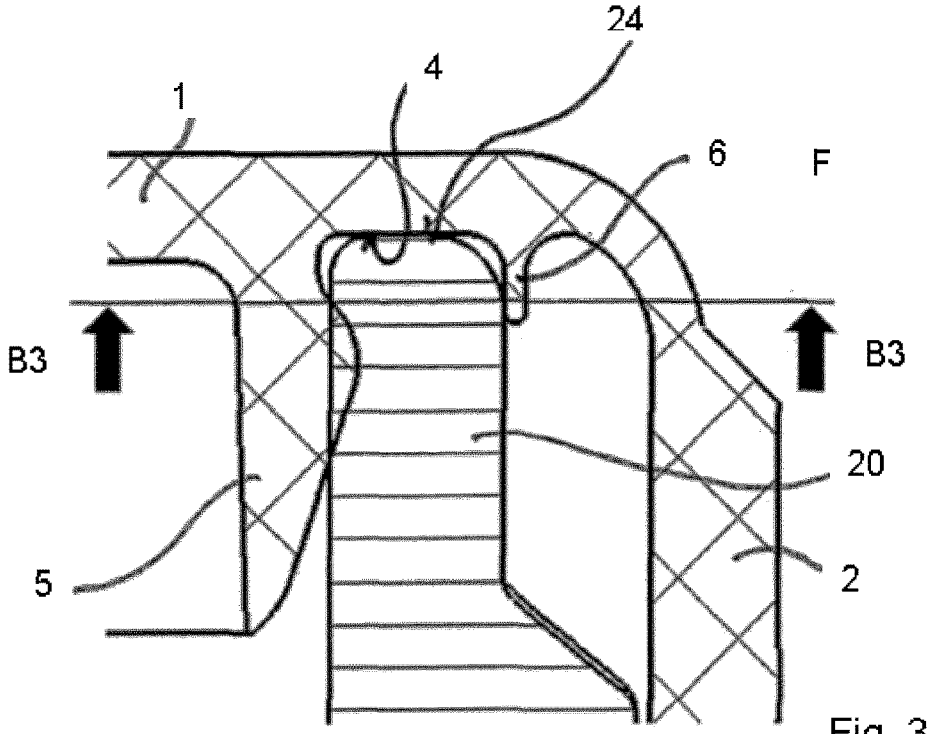
Figure 3B:
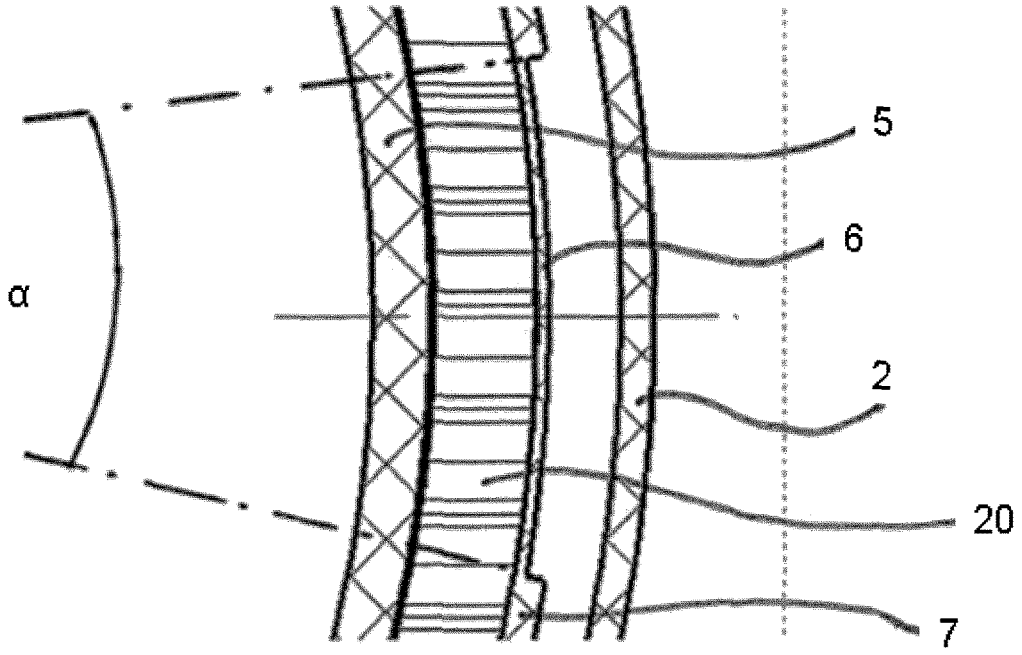
Figure 4:
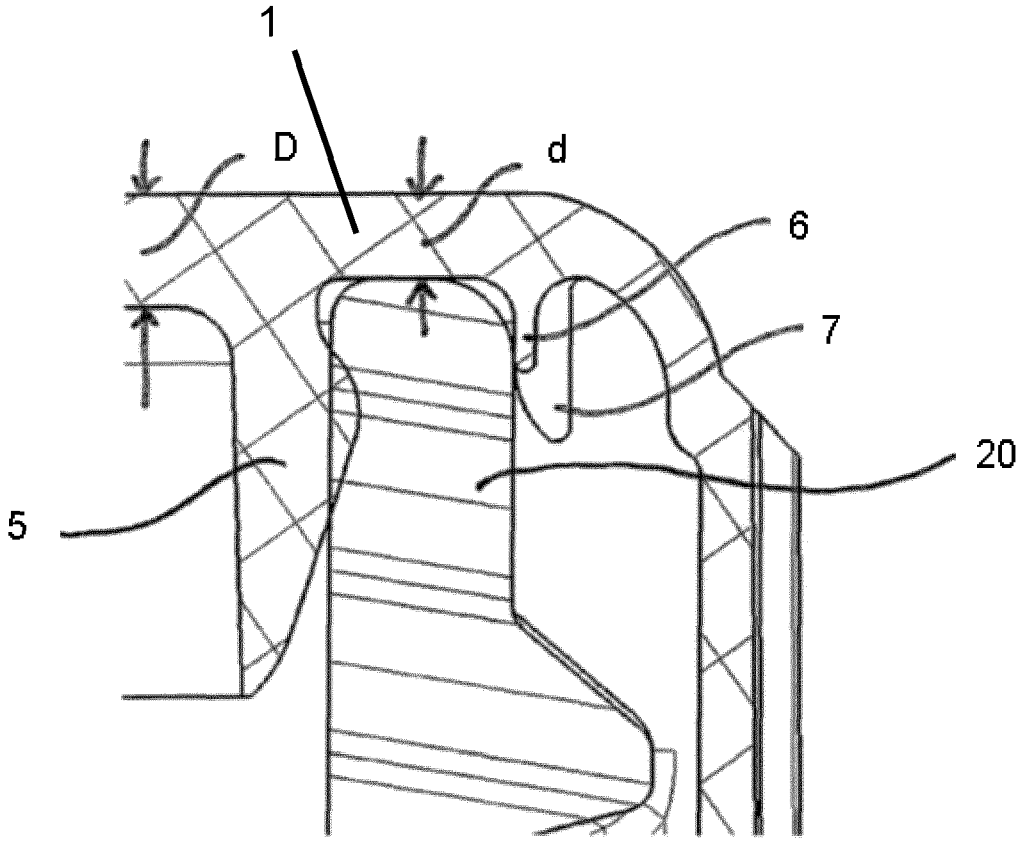
Figure 5A:
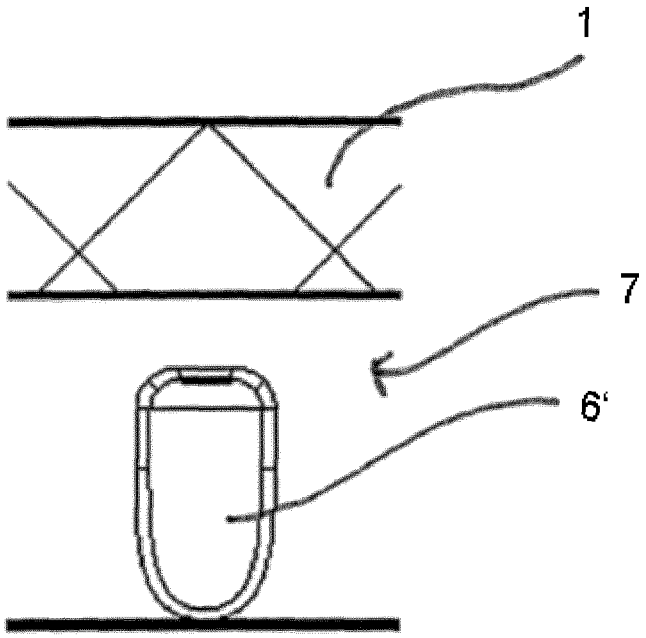
Figure 5B:
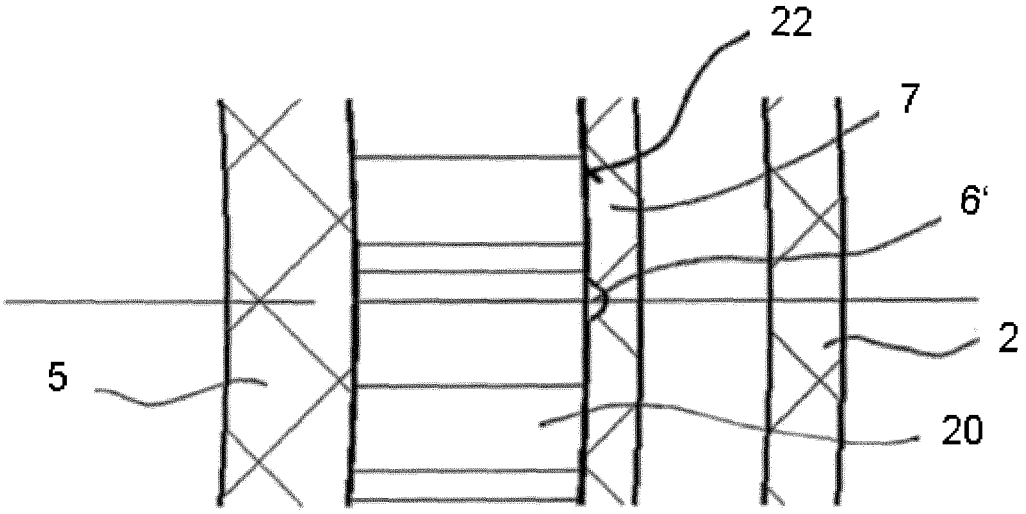
Figure 6A:
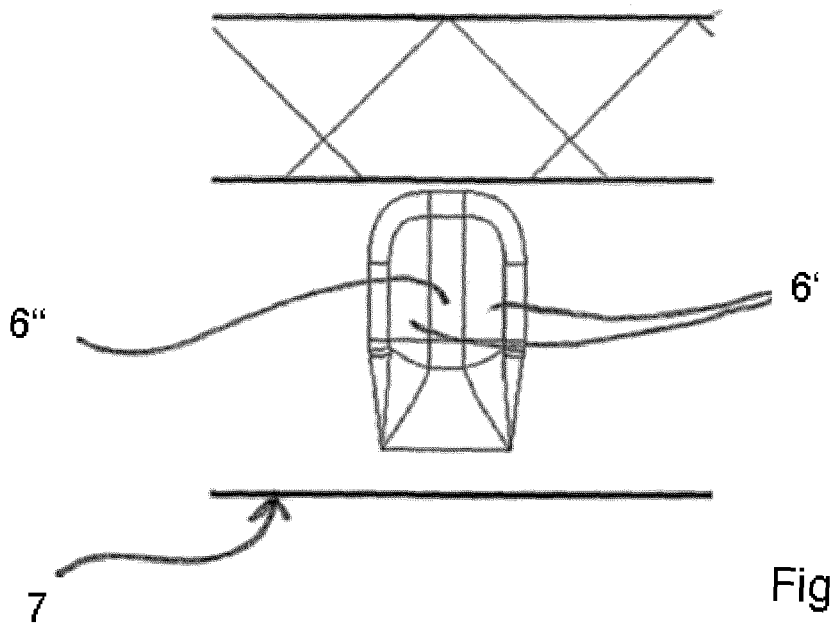
Figure 6B:
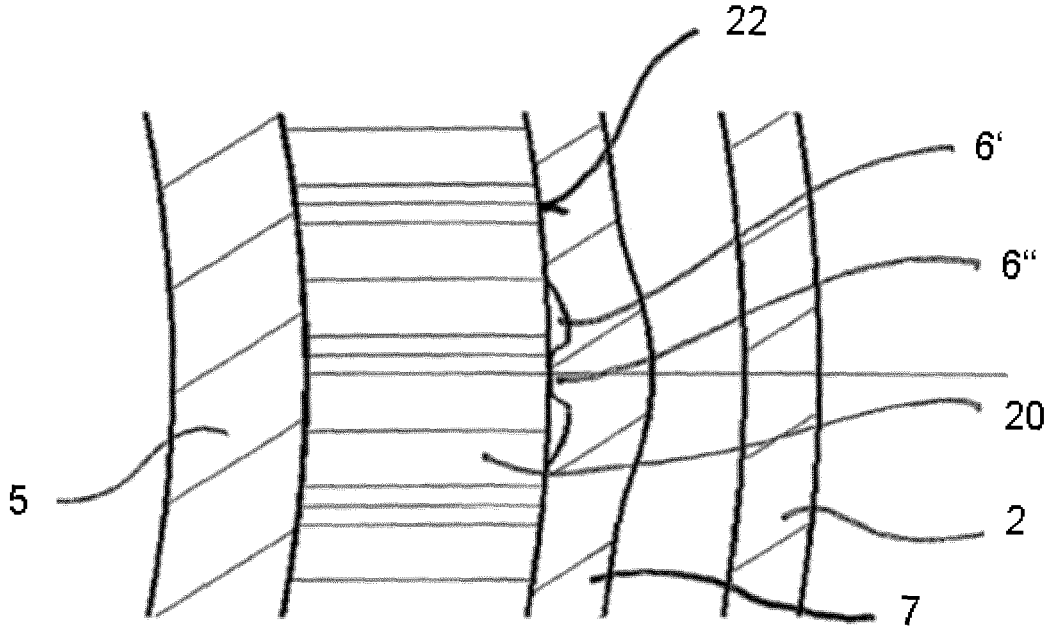
Figure 7A:
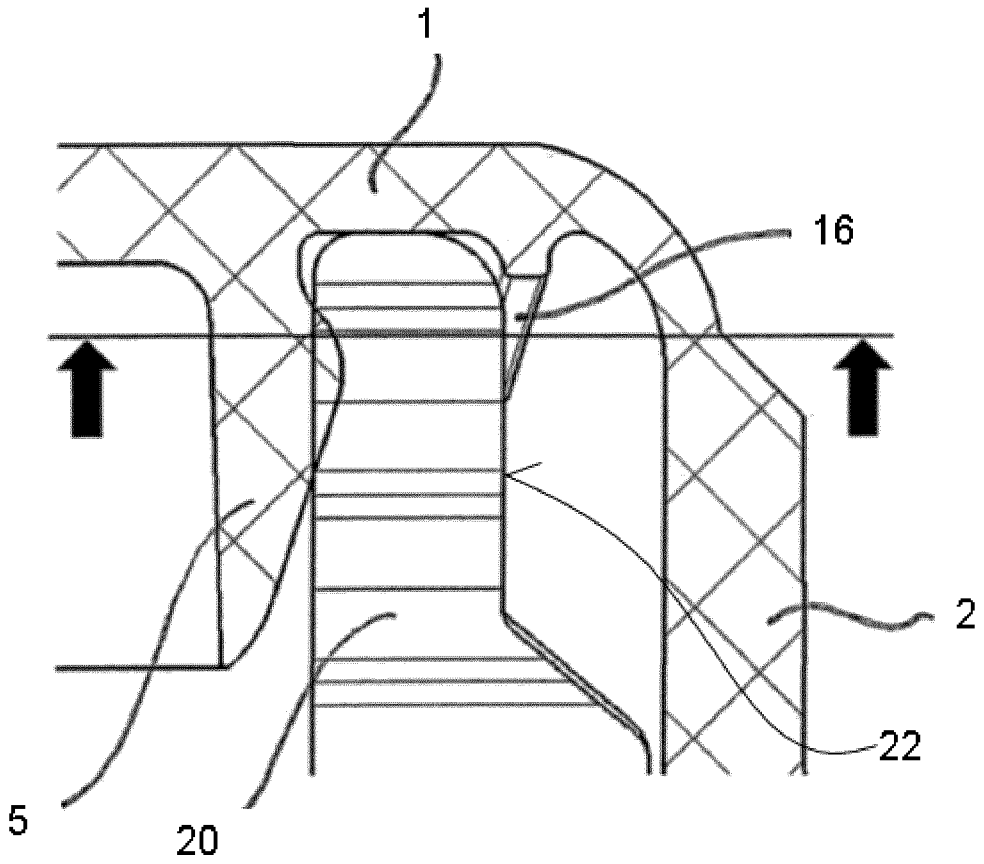
Figure 7B:
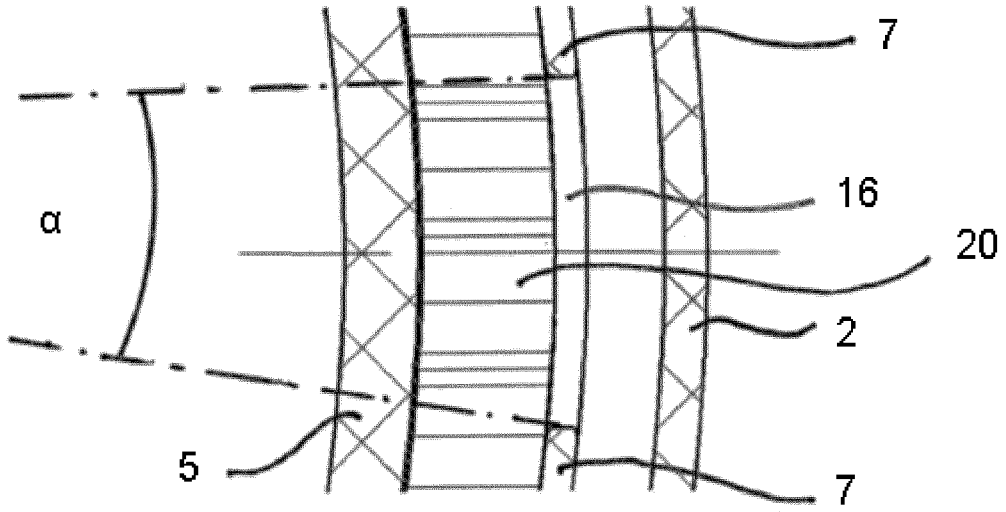

Further advantages, features and possible uses of the present invention will be apparent from the description hereinafter of preferred embodiments and the accompanying Figures in which:

FIG. 1A shows a section containing the axis of a closure through a screw closure fitted on to a bottle neck in accordance with a first embodiment of the invention, wherein the view is limited to the region of the seals and shows a normal portions of the outer seal, FIG. 1B shows a section perpendicular to the axis of the closure in FIG. 1A corresponding to section line B-B, FIG. 2 shows a section corresponding to FIG. 1A of a closure on a container under an increased pressure, FIG. 3A shows a section through the portion diametrally opposite to the portion shown in FIG. 1A of the same closure as shown in FIG. 1A with an outer seal weakened in a segment, FIG. 3B shows a section along line B3-B3 in FIG. 3A, FIG. 4 shows a view corresponding to FIG. 3A with an additionally illustrated contour of the outer seal outside the weakened region, FIG. 5A shows a plan view of a portion of the internal surface of an outer seal according to a further embodiment, having a recess in the sealing region, FIG. 5B shows a horizontal section through a closure as shown in FIG. 5A, the section plane extending through the recess and the section showing only a portion of the closure on a bottle neck, FIG. 6A shows a plan view of a portion of the internal surface of an outer seal according to a further embodiment, having a projection in the sealing region, FIG. 6B shows a horizontal section through a closure as shown in FIG. 6A, the section plane extending through the projection and the section showing only a portion of the closure on a bottle neck, FIG. 7A shows a section similar to FIG. 1A of a further embodiment, FIG. 7B shows a horizontal section through a closure as shown in FIG. 6A, the section plane extending through the weakened region of the outer seal and the section showing only a portion of the closure on a bottle neck, and FIG. 8 for providing a better overview shows a cross-section through the complete closure as shown in FIGS. 1 and 3.

FIG. 1 shows an axial section through the edge of a container neck with a closure 100 fitted thereon. The container neck is described hereinafter as a bottle neck and shows the contour of a bottle neck edge of a PET bottle with a 30 or 43 mm thread.

The inner seal 5 is shown here overlapping with the internal surface of the bottle neck 20, which however is only intended to indicate that the external surface of the inner seal, in particular the bead 5' provided on the outer surface, bears with elastic prestressing against the internal surface of the bottle neck 20, as is also shown in FIG. 2, FIG. 2 additionally showing a head plate 1 which is bulged up by an increased internal pressure. The increased pressure also provides that the conical outside surface between the maximum diameter of the bead 5' and the lower free end of the inner seal 5 is acted upon by the increased internal pressure so that, as from a certain internal pressure, the inner seal 5 or its outwardly projecting bead lifts off the internal surface of the bottle neck 20 and thus allows the pressure to escape into the region between the outer seal 7 and the inner seal 5.

The state shown in FIG. 2 corresponds to a situation in which the inner seal 5 is lifted off and tilted to such an extent that it is lifted off the internal surface 22 of the bottle neck and is now non-sealing. The rounded configuration provided in accordance with usual standards at the inner upper edge of the bottle neck in turn contributes to the inner seal at least locally losing sealing contact with the bottle neck as from a certain pressure.

FIG. 1A shows a part of the closure 100 having a head plate 1, a cap skirt 2 with a screw thread 3 and an inner seal 5 and an outer seal 7. When the closure 100 is screwed on to a bottle neck 20 the mouth of the bottle neck 20 is moved between the outer seal 7 and the inner seal 5, more specifically generally until the end face 24 of the bottle neck mouth bears against an abutment surface 4 of the annular portion 14 at the underside of the head plate 1, that is between the two seals 5 and 7.

The conically inwardly tapering lower portion of the inner seal 5 and the lower portion of the outer seal 7, which portion expands conically or in a rounded configuration, like the rounded configurations at the upper edge of the bottle neck mouth, contribute to the bottle neck 20, when the closure 100 is being fitted in place, being displaced between the inner seal 5 and the outer seal 7 and not compressing a seal which bears against the end face 24 of the bottle neck.

FIG. 2 shows (once again only as a portion) a head plate 1 which is bulged up under an increased internal pressure so that the internal pressure triggers a lack of sealing integrity of the inner seal 5, wherein the internal spacing between the bead 5' of the inner seal 5 and the inside 22 of the bottle neck 20 is shown on a somewhat exaggerated scale to illustrate the effects which occur. By virtue of the bulging action in respect of the head plate 1 which is also promoted by a smaller wall thickness d of the head plate 1 in the region of the annular portion 14 of the head plate 1 (see FIG. 4) the inner seal 5 has a tendency to tip inwardly, as initially already occurs due to the radially inward displacement of the bead 5' upon engagement with the inner sealing surface of the bottle neck 20. In the region radially within the inner seal 5 the head plate 1 is of a somewhat greater wall thickness D, wherein the different wall thicknesses d, D are not a necessary feature but can simplify or promote the desired overpressure limitation in respect of the closure.

As an alternative to a reduced wall thickness for the annular portion 14 or in addition a groove can be provided at the transition from the abutment surface 4 and the inner seal 5 on the inside of the head plate 1, which makes the inner part of the head plate 1 with the inner seal 5 even more moveable with respect to the radially outer portion 14, and this makes it even easier for the head plate 1 to assume its bulged configuration and for the inner seal 5 to tilt and axially lift off until it loses its sealing integrity. With a sufficiently high internal pressure also acting on the outside of the inner seal 5, insofar as it does not have an opposite surface acted upon with pressure in the axial direction the bead 5' lifts off at least at some locations from the internal surface 22 of the bottle neck 20 so that the pressure can escape until the bulge in the head plate 1 has correspondingly reversed and the elastic return forces of the inner seal move the bead 5' of the inner seal 5 into sealing engagement with the bottle neck again.

FIG. 3A shows the same closure as FIG. 1A with the section plane however extending through a weakened region 6 of the outer seal 7.

In this case the weakened region 6 comprises an optionally axially shortened portion 6 of the outer seal 7, which portion is of a reduced wall thickness and which admittedly is of the same inside diameter as the outer seal 7 in the rest of the region, but is of a markedly smaller outside diameter. FIG. 3B shows a section through the line B3-B3 in FIG. 3A. The inner seal 5 bears against the internal surface 21 of the bottle neck 20 (the overlap of the inner seal 5 with the bottle neck 20 in FIG. 3A is only intended to represent the stress-free state before the inner seal 5 or the bead 5' thereof is pressed inwardly by the bottle neck).

The upper third of the outer seal 7, adjoining the head plate, is disposed in the region of a radius of curvature at the upper edge of the neck mouth and thus does not come into contact with the bottle neck and the lower third is already radially enlarged in order in that way, when fitting the closure on to a bottle neck, to make it easier for the mouth of the bottle neck 20 to slide into the intermediate space between the two seals 5 and 7. If now the seal 7 is shortened over a certain angle sector α which for example can be 30° to half or the entire axial length of the outer seal 7 then in that region there is still only an axially relative short portion of the outer seal 7 in contact with the outside 21 of the bottle neck 20, in which case a relatively slight increased pressure within the outer seal 7 is sufficient to lift that relatively short portion which is still in sealing contact off the outside 21 of the bottle neck 20 and thus cause pressure relief.

The outer seal 7 of which two end portions are shown in the angle portion illustrated in FIG. 3B is not only axially shortened in the weakened segment within the angle sector α but is also replaced by a weakened region 6 which is of reduced wall thickness but which is of the same inside diameter as the inner seal 7 elsewhere. Under normal conditions, that is to say when no or only a slight increased pressure of for example 2 bars prevails in the region between the inner seal 5 and the outer seal 7 the weakened region 6 of the outer seal therefore also bears sealingly against the outside 22 of the bottle neck 20 and provides protection from the ingress of germs prior to first being put to use, that is to say on the way from the filler to the consumer.

The dimensional relationships between the weakened region 6 of the outer seal 7 are moreover shown once again in FIG. 4 where, in addition to the weakened region 6 shown in section, the contour of the outer seal 7 has also been shown again, as is to be found in the regions of the outer seal 7 outside the weakened region 6. It can also be seen from FIG. 4 that the wall thickness d of the head plate in the region between the inner seal 5 and the outer seal 7 is somewhat smaller than the wall thickness D radially within the inner seal 5.

FIG. 8 shows the complete closure in the sectional plane in FIGS. 1A and 3A. In this case FIG. 1A corresponds to the region I enclosed in the broken line in FIG. 8 and FIG. 3A corresponds to the region III enclosed in the broken line in FIG. 8.

In the weakened region 6 on the right-hand side in FIG. 8 the outer seal 7 is axially shortened and reduced in its wall thickness whereby the outer seal 7 is more easily stretchable in the weakened region 6 and yields at a lower internal pressure than would be the case with a uniform configuration of the outer seal 7 with full wall thickness and axial length as in the region I and in the other region.

FIG. 5A shows a small portion of the head plate 1 with the seal 7 extending downwardly from the head plate 1, FIG. 5A being a plan view on to the internal surface of the outer seal 7, which is normally in sealing contact with the external surface 22 of the bottle neck.

In this case the internal surface of the outer seal has a small groove-like recess 6' which in the axial direction bridges over the region in which the seal bears in other respects sealingly against the outside 22 of the bottle neck 20. This is diagrammatically shown once again in FIG. 5B in a section passing through the recess 6'. For practical purposes it is sufficient if the cross-section of the groove-like recess 6', as can be seen in FIG. 5B, is less than 0.5 $mm^2$, in particular less than 0.2 $mm^2$. The approximately semicircular recess 6' in the section in FIG. 5B could for example be of a radius of 0.1 to 0.2 mm.

FIGS. 6A and 6B represent a further embodiment in which, instead of a recess 6', there is a radially inwardly projecting web or a rib or a projection 6". Even if the wall thickness of the outer seal 7 is constant in the circumferential direction of the outer seal and on both sides of the projection or the rib 6" nonetheless short portions of the inner seal 7 on both sides of the rib 6" are lifted off the external surface 22 of the bottle neck 20, which effectively means that two small recesses 6' of wedge-shaped cross-section are in turn formed on both sides of the rib 6". Here too the rib 6" is of such a size that the cross-section of the recesses 6' formed in that way in total is not more than 0.5 $mm^2$, preferably less than 0.2 $mm^2$. It will be appreciated that here too the rib 6" extends in a straight line or curved in the axial direction over the sealing region of the outer seal 7 so that the recess 6' makes a connection of the space between the outer and inner seals with the outside of the bottle neck 20.

FIG. 7 finally shows yet a further embodiment in which the outer seal 7 has been axially shortened in an angle region α so that in the angle sector α of the weakened region 16 there is only a very small contact axially between the outer seal 7 or the weakened region 16 and the bottle neck 20 or its external surface 22. It is of such a dimension that, when the head plate assumes the bulging configuration, the outer seal in spite of its proximity to a notional pivot point of the bulged part of the head plate 1 is still displaced sufficiently axially upwardly to open a gas passage.

The invention is based in substance on two effects, namely on the one hand making use of the upward bulging of the head plate, that occurs at the internal pressure, in order firstly to open the inner seal to such an extent that unwantedly high internal pressure of for example more than 3 bars is passed to the outer seal. Secondly that outer seal is also weakened in an angle sector in such a way that, when acted upon with the pressure exceeding for example 3 bars, it also yields and the pressure can be relieved from the container by gas discharge.

Those effects are also achieved inter alia by using the material polyethylene, in particular HDPE, for the closure, in conjunction with a wall thickness for the head plate of less than 2 mm, preferably less than 1.0 mm, as well as an inner seal, the bead of which is relatively close to the head plate and provides a sealing effect there and thus upon the movement of the region in question of the head plate at an increased internal pressure is axially displaced sufficiently far.

The invention also concerns in particular a combination of a container neck or a container with a plastic closure, wherein the maximum outside diameter of the outer seal is between 0.2 and 0.4 mm larger than the corresponding inside diameter of the container neck opening, while the inside diameter of the outer seal is also about 0.2 to 0.4 mm smaller than the corresponding outside diameter of the container neck in the respective angular position. The closure according to the invention is particularly well suitable for containers with cylindrical container necks which are of an inside diameter of 40 or 30 mm but can also be used for smaller closure diameters of for example 28 mm. The above-described embodiments are accordingly adapted in respect of their dimensions to corresponding standardised container necks or bottle necks.

LIST OF REFERENCES

1 head plate
2 cap skirt
3 screw thread on the closure
4 abutment surface (internal surface of the head plate between the seals 5, 7)
5 inner seal
5' radially projecting region, bead
6 weakened region
6' weakened region
6" weakened region
7 outer seal
α angle sector
11 internal surface of the head plate
14 annular portion of the head plate 1 with the abutment surface 4
16 weakened region
20 bottle neck
21 external surface/outside of the bottle neck
22 internal surface of the bottle neck
100 closure

The invention claimed is:

1. A plastic closure for fitting on to the neck of a liquid container in positively locking and sealed relationship, the neck of the liquid container having an inside, comprising a head plate (1) provided for covering a container opening, the head plate having an edge, and an outer seal (7) which is circumferential approximately parallel to the edge of the head plate (1) and is provided for engagement with the outside of a container neck (20) defining the container opening, and an inner seal (5) which is circumferential within the outer seal (7) and parallel thereto and which is provided for engagement with the inside of the container neck, wherein the outer and the inner seals (7, 5) respectively project from an inside (11) of the head plate (1) in the direction of the container neck to be covered by the head plate, characterised in that the outer seal (7) has a weakened region (6, 6', 6", 16) in at least one circumferential portion, wherein the configuration of the closure is such that the outer seal yields in the weakened region (6, 6', 6", 16) at a lower internal positive pressure than without the weakened region, and wherein the plastic closure is in the form of a screw closure, wherein the screw closure (100) has the head plate (1) and a cylindrical cap skirt (2) with a female thread (3) which define an axis (50) of the closure, wherein the outer and inner seals are in the form of webs which extend circumferentially in an annular configuration at a spacing relative to the cap skirt and parallel thereto and the weakened region is restricted to an angle sector (α) measured with respect to the axis, wherein the weakened region comprises a circumferential portion of the outer seal, that is axially shortened in the angle sector (α).

2. A screw closure according to claim 1 characterised in that it has a sealing region which is an axial region of the outer seal of constant inside diameter, which at least partially includes a central third of the axial length of the outer seal and corresponds at maximum to the axial length of the outer seal.

3. A screw closure according to claim 1 characterised in that the weakened region (6, 6', 6", 16) includes a groove (6') or rib (6") which extends on the inside surface of the outer seal, and which extends on the inside of the outer seal over the axial extent of a sealing region of the outer seal.

4. A screw closure according to claim 3 characterised in that the groove (6') or the rib (6") extends substantially axially and is of a cross-section of less than 0.05 $mm^2$.

5. A screw closure according to claim 3 characterised in that the axial length of the shortened circumferential portion is less than ⅔ of the axial length of the outer seal outside the weakened region (6, 6', 6", 16).

6. A screw closure according to claim 1 characterised in that the weakened region (6) comprises a circumferential portion of the outer seal (7) with a wall thickness which is reduced in relation to the rest of the outer seal (7), wherein the outer seal (7) in the weakened region (6) thereof is of the same internal radius as the outer seal (7) elsewhere but is of a smaller external radius.

7. A screw closure according to claim 2 characterised in that the reduced wall thickness of the outer seal in the weakened region (6) extends axially over at least a part of the central axial third of the length of the outer seal and is less than half of the wall thickness outside the weakened region, wherein the extent of the weakened region (6) in the circumferential direction is preferably restricted to preferably a circumferential angle of between 20° and 90°.

8. A screw closure according to claim 6 characterised in that the weakened region of reduced wall thickness extends axially from a free axial end at least into the upper axial third, with respect to the axial extent of the outer seal outside the weakened region.

9. A screw closure according to claim 1 characterised in that a portion (14) in the form of an annular disk of the head plate (1) between the outer and inner seals defines an axial abutment surface (4) for the end face (24) of a container mouth opening and the maximum outside diameter of the inner seal (5) is provided at an axial spacing of between 0.4 and 1.0 mm from the abutment surface.

10. A screw closure according to claim 1 characterised in that a circumferential groove is provided in the internal surface (11) of the head plate at the transition from the portion (4) of the head plate (1), that is in the form of an annular disk, to the inner seal (5).

11. A screw closure according to claim 1 characterised in that the inner seal (5) is of an axial length of at least 2 mm with an end portion which conically tapers from its maximum diameter towards its axially free end.

12. A screw closure according to claim 1 characterised in that the maximum outside diameter of the inner seal is greater by at least 1.5 mm than its maximum inside diameter.

13. A screw closure according to claim 1 characterised in that the screw closure comprises polyethylene and the wall thickness of the head plate within the region embraced by the outer seal is at a maximum 1.2 mm.

14. A container for liquids having a container neck on which a plastic closure is fixedly and sealingly fitted, characterised in that it has a plastic closure according to claim 1.

15. A container according to claim 14 characterised in that the container neck has a male thread and the plastic closure is a screw closure.

16. A container according to claim 14 characterised in that the maximum external radius of the inner seal is greater by 0.3 to 0.7 mm than the nominal internal radius of the container neck at the respective position.

17. A container having a screw closure according to claim 14 characterised in that a constant internal radius of the outer seal, insofar as same comes into sealing contact with the outside (22) of the container neck (20), is 0.3 to 0.7 mm smaller than the nominal constant external radius of the container neck (20) in the region of the sealing contact with the outer seal.

18. A screw closure according to claim 1 wherein the configuration of the closure is such that the outer seal yields in the weakened region at a lower internal positive pressure than in the outer seal outside the weakened region.

19. A screw closure according to claim 4 characterised in that the groove (6') or the rib (6") is of a cross-section of less than 0.02 $mm^2$.

* * * * *